United States Patent [19]

Hopeman

[11] Patent Number: 4,779,392

[45] Date of Patent: Oct. 25, 1988

[54] BUILDING WALL

[75] Inventor: Henry W. Hopeman; William I. Medley, both of Waynesboro, Va.

[73] Assignee: Hopeman Brothers, Inc., Waynesboro, Va.

[21] Appl. No.: 47,638

[22] Filed: May 8, 1987

[51] Int. Cl.[4] ..... E04B 2/76

[52] U.S. Cl. ..... 52/481; 52/241; 52/595; 52/766; 52/775

[58] Field of Search ..... 52/481, 486, 489, 511, 52/512, 238.1, 239, 582, 775, 766, 762, 586–588, 592–595, 241

[56] References Cited

U.S. PATENT DOCUMENTS

| | | | |
|---|---|---|---|
| 2,010,412 | 8/1935 | Parsons | 52/481 X |
| 2,082,314 | 6/1937 | Venzle | 52/486 X |
| 2,128,797 | 8/1938 | Bohnsack | 52/481 |
| 2,227,452 | 1/1941 | Jullien | 52/762 |
| 2,633,652 | 4/1953 | Wagner et al. | 52/762 X |
| 2,994,413 | 8/1961 | Levy et al. | 52/481 X |
| 2,999,568 | 9/1961 | Ludwig et al. | 52/762 X |
| 3,026,977 | 3/1962 | Pollock et al. | 52/704 X |
| 3,312,025 | 4/1967 | Deakins | 52/775 X |
| 3,327,440 | 6/1967 | Watkins | 52/239 |
| 3,608,266 | 9/1971 | Satkin et al. | 52/486 X |
| 3,913,292 | 10/1975 | Braekkan | 52/241 X |
| 4,557,091 | 12/1985 | Auer | 52/595 X |

*Primary Examiner*—David A. Scherbel
*Assistant Examiner*—Richard E. Chilcot, Jr.
*Attorney, Agent, or Firm*—Howson & Howson

[57] ABSTRACT

A building wall comprises channel-shaped uprights and metal-clad insulating panels arranged in alternating sequence so that the interior faces of the panels form parts of the interior walls of the building while the exterior faces of the panels form parts of the exterior walls of the building. Flanges are formed along the vertical edges of the sheet metal outer faces of the panels. These flanges extend into the open sides of the channel-shaped uprights and are situated in facing relationship with the inner faces of the uprights. Vertically aligned lances, struck out from the opposed plates of the channel-shaped uprights, are engaged with L-shaped slots of the flanges of the panels. The lances have camming surfaces which tightly urge the flanges of the panels against the inner faces of the side plates of the uprights so that the flanges and uprights reinforce each other to form a strong, rigid wall structure. The exterior metal faces of the panels approach each other at a location midway between the planes of the side plates of the upright channels, and are bent rearwardly at that location to provide two closely approaching faces, between which a weatherproof seal is provided.

6 Claims, 3 Drawing Sheets

FIG. 3
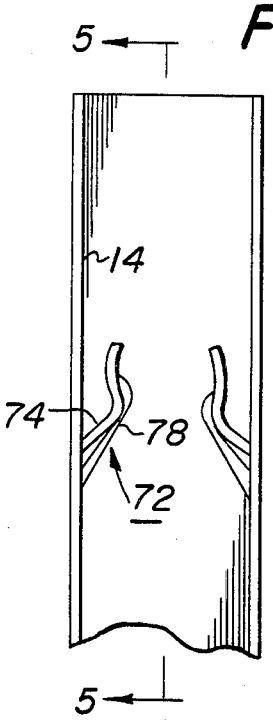
FIG. 4
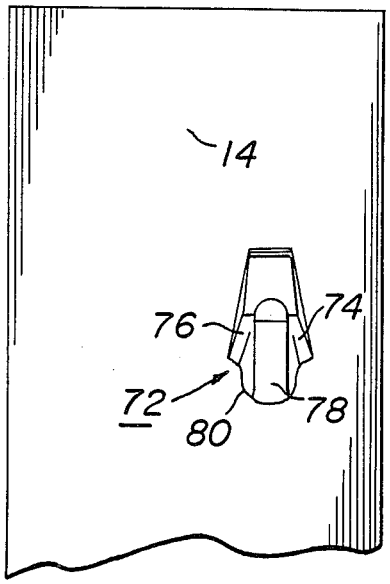
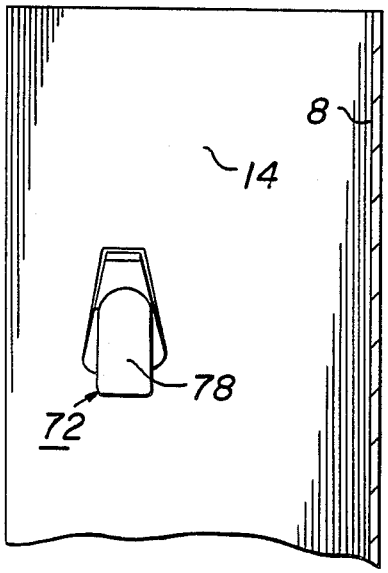
FIG. 5
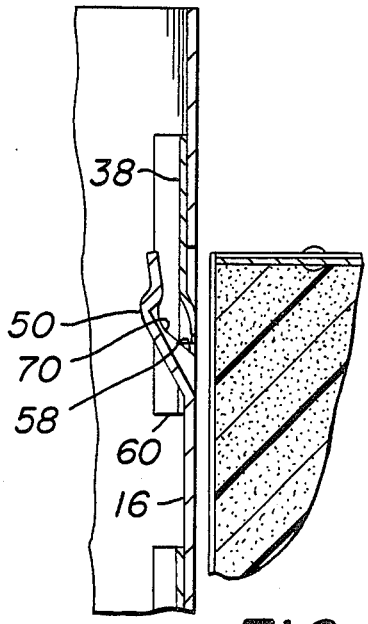
FIG. 6

BUILDING WALL

BRIEF SUMMARY OF THE INVENTION

This invention relates to building walls, and in particular to a wall structure suitable for gasoline station buildings and the like, wherein strength and rigidity, structural simplicity, and ease of assembly are important factors.

In the erection of the walls of most buildings, exterior wall panels are attached to the outside of a wall-supporting framework, and separate interior wall panels are attached to the inside of the framework. In general, either the fasteners used to attach the wall panels to the framework are exposed in the completed structure, or special steps are taken to hide the fasteners from view. Construction of these conventional walls is time-consuming. Furthermore, logistical problems arise because of the fact that conventional walls require numerous different parts.

The principal object of the present invention is to provide a wall structure which can be erected rapidly and easily without exposed fasteners, and which nevertheless possesses a high degree of strength and rigidity, and requires a relatively small number of separate parts.

The building wall in accordance with the invention comprises a series of upright support columns, with wall panels extending between the columns. A minimum preliminary supporting structure comprising upper and lower channels is first erected. These channels are notched at appropriate intervals to receive the columns. The columns are secured to the upper and lower channels preferably by welding. After the columns are secured in place, the wall panels are attached to the columns by engagement of L-shaped notches in flanges of the wall panels with struck-out lances on the columns. The most important feature of the invention is the manner in which the support columns and wall panels are attached to each other.

Each column is in the form of a sheet metal channel having a substantially U-shaped horizontal cross-section and comprising two parallel, spaced, opposed vertically elongated plates connected by a web and extending perpendicular to the planes of said faces of the panels. Each plate has an inner face facing toward the opposite plate, and each plate has a series of vertically spaced struck-out lances extending both inwardly from its inner face toward the opposite plate, and upwardly toward the top of the column.

At least one of the faces of each panel is a metal sheet having a flange extending along one vertical edge of the panel. The flange has a planar part situated perpendicular to the planes of the faces of the panel. Each flange has a vertical edge and a series of vertically spaced L-shaped slots. Each of these slots has a horizontal leg opening to the edge of the flange, and a vertical leg extending upwardly from the horizontal leg at a location in the planar part, spaced from the edge.

The planar part of the flange of one panel is in facing contact with the inner face of one of the plates of the column, and the planar part of the flange of another panel is similarly in facing contact with the inner face of the opposite plate of the column.

The lances of each plate are received in the vertical legs of the L-shaped slots of the flange with which the face of the plate is in facing contact.

Preferably, the lances are designed with oblique camming surfaces. The weight of the panels is resolved into forces acting perpendicularly against the camming surfaces and horizontal forces urging the flanges against the plates of the column. The width of each lance is preferably substantially equal to the width of the upper boundary of the vertical leg of the slot receiving the lance so that the flanges are secured against movement in directions perpendicular to the faces of the panels. Preferably the lances are tapered to facilitate engagement of the lances with the L-shaped slots. Each lance also preferably has a curved cross-section for reinforcement against bending under the forces acting in directions perpendicular to the camming surfaces.

The metal sheet which constitutes one of the faces of each panel extends past one plate of the column vertical to a line approximately midway between the planes of the inner faces of the plates of the column. From that line, the metal sheet extends perpendicular to the panel faces and toward the web of the column. The perpendicular portion is connected to the slotted portion of the flange by a return portion extending parallel to and spaced from the plane of the panel face. Adjacent panels thus meet each other in front of the column. A seal is provided between the meeting perpendicular portions of adjacent panels. Panel flanges are also preferably provided with flared portions to facilitate insertion between the plates of the column.

Preferably, each panel has a core of insulating material between its inner and outer faces, and the coplanar inner faces of the wall panels constitute a part of the interior wall of a building, and the coplanar outer faces of the wall panels constitute a part of the outside wall. Thus, to erect a building wall it is necessary only to erect the upper and lower channels, to secure uprights in the notches, and to hang wall panels between the uprights. It is not necessary to attach inner and outer wall panels separately to a framework, and there is no need for fasteners which are exposed in the completed structure. The panels and columns can be comparatively light in weight. However, when secured together by the engagement of lances and L-shaped slots in the manner described, they reinforce each other and form a very strong and rigid wall structure.

Various further objects and advantages of the invention will be apparent from the following detailed description when read in conjunction with the drawings.

BRIEF DESCRIPTION OF THE DRAWINGS

FIG. 3 is a front elevation of an upright column in accordance with the invention, showing the shape of the struck-out lances in the side plates;

FIG. 4 is a left side elevation of the upright column of FIG. 3;

FIG. 5 is a vertical section taken on plane 5—5 in FIG. 3;

FIG. 6 is a vertical section taken on plane 6—6 of FIG. 1; and

DETAILED DESCRIPTION

Figure 1:
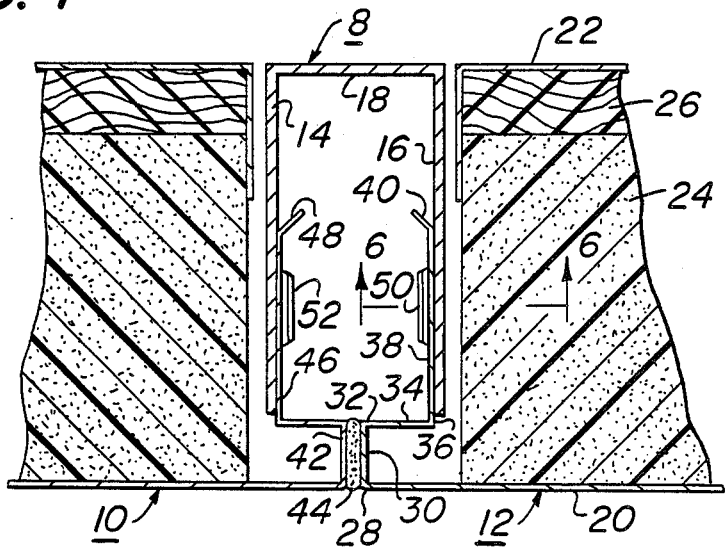
FIG. 1 is a fragmentary horizontal section through a column of a wall in accordance with the invention, showing the manner in which wall panels are attached to both sides of the column.

A building wall in accordance with the invention comprises a series of spaced upright support columns with wall panels connected between them. FIG. 1 shows a column 8 having wall panels 10 and 12 connected to it. Column 8 is in the form of a sheet metal channel, typically of fourteen gauge steel, having spaced, opposed, parallel side panels 14 and 16 connected by a web 18. Wall panel 12 has a sheet metal outer face 20, typically of twenty gauge steel, a sheet metal inner face 22, and a core between the faces, comprising one or more layers of insulating material. In the case of FIG. 1, the insulating core consists of a polystyrene foam layer 24, and a gypsum layer 26. Wall panel 10 is similar to panel 12, and the outer faces of the two panels are coplanar, as are the inner faces. Preferably, the inner faces of the wall are coplanar with web 18 of the upright column. The coplanar inner faces of the panels, along with web 18 of the column, form part of the interior wall of the building. The web can be provided with slots (not shown) for attachment of shelves. The outer faces of the panels form part of the exterior wall of the building. Each panel, therefore, contains all of the layers of the building wall, from the innermost layer to the outermost layer.

The sheet metal outer face 20 of panel 12 extends beyond the core, and past plate 16 of column 8 approximately to an imaginary vertical line located approximately midway between the planes of the inner faces of plates 14 and 16. Sheet 20 is bent perpendicularly at 28 to form a perpendicular portion 30 extending toward the web of the column, and is bent again at 32 to form a return portion 34 which extends parallel to and behind the face of the panel to still another bend at 36. Extending rearwardly from bend 36 is a planar flange portion 38. Flange portion 38 is perpendicular to the panel faces and situated against the inner face of plate 16 of the column. The flange has a flared portion 40 which facilitates insertion of the flange into the space between the columns.

The flange structure of wall panel 10 is similar to that of panel 12, in that the sheet of the outer face of the panel extends to a vertical line approximately midway between the planes of the inner faces of the plates of the column. The flange structure has a rearwardly extending portion 42 meeting portion 30. Caulking 44 provides a weather-proof seal between portions 30 and 42 of the panel.

The flange of panel 10 has a planar portion 46 extending rearwardly along the inner face of plate 14 of the column, and is flared at 48. Planar portions 38 and 46 of the flanges are engaged respectively by lances 50 and 52, which are struck out from plates 16 and 14 of the column.

Figure 2:
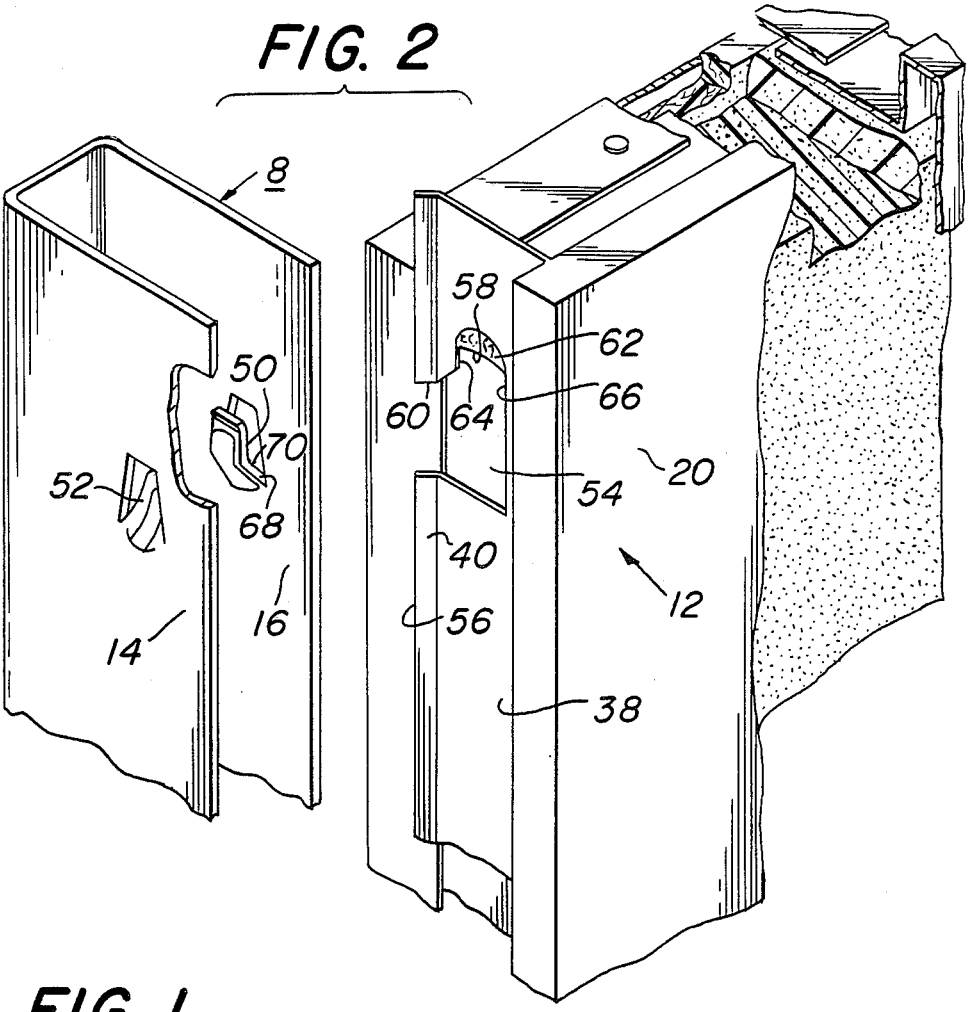
FIG. 2 is a fragmentary exploded perspective showing a typical upright column and panel, in which the panel is partially broken away to show its internal structure.

The shapes of the lances can be seen in FIG. 2. Each lance is tapered and is struck out from a plate of column 8 by means of a sheet metal punch, and extends both inwardly toward the opposite plate, and upwardly toward the upper end of the column. Each plate has a series of vertically spaced similar lances, only one of which is shown for each plate in FIG. 2.

The flange of the panel in FIG. 2 has an L-shaped slot 54. The slot has a horizontal leg which opens to vertical edge 56 of the flange, and which extends through flared portion 40 and into planar portion 38 of the flange. Slot 54 also includes a vertical leg which extends upwardly from the horizontal leg at a location in the planar portion 38 of the flange. The upper end 58 of the slot is located above the upper boundary 60 of the slot opening at edge 56. Consequently, a hook is formed which is engageable with lance 50 of the upright. Area 62 just above boundary 58 of the slot is punched inwardly. Threfore, boundary 58 is curved inwardly so that it can enter the opening from which lance 50 is struck out. The width of the vertical portion of the slot between edges 64 and 66 is approximately equal to the width of the lower portion 68 of lance 50. Consequently, when the lance and slot are fully engaged, the panel cannot move relative to the upright column in directions perpendicular to the panel's faces.

Although not shown in FIG. 2, the upright has a series of vertically aligned lances corresponding to lance 50, and the flange of panel 12 has a corresponding series of slots corresponding to slot 54. The lances and slots are spaced at corresponding intervals so that all of the slots can be engaged with their corresponding lances simultaneously. Engagement takes place by positioning the so that, by horizontal movement of the flange of the panel into the space between the side plates of the column, the lances enter the openings of the slot in vertical edge 56. When the panel is in position so that the lances are vertically aligned with the vertical legs of the slots, the panel is lowered as illustrated in FIG. 6. Boundary 58 of the slot engages camming surfaces constituted by the oblique lower portions of both side edges of lance 50, one such camming surface being shown at 70. These camming surfaces urge flange 38 tightly against plate 16, and this tight engagement is maintained as a result of the weight of the wall panels acting on the camming surfaces of lance 50 and the camming surfaces of the other lances with which lance 50 is vertically aligned. The result of this tight engagement is a very strong and rigid wall structure, suitable as a combined inner and outer wall for a building.

The details of the lances of the upright are depicted in FIGS. 3, 4 and 5. Lance 72 has camming surfaces at 74 and 76, and has a curved cross-section which is convex toward the inside of the column, whereby a reinforcing rib is formed at 78. As shown in FIG. 4, lance 72 meets plate 14 along a curved line 80. The curved meeting line and the rib provide very rigid struck-out lance which is resistant to downward bending under the weight of the wall panel.

Figure 7:
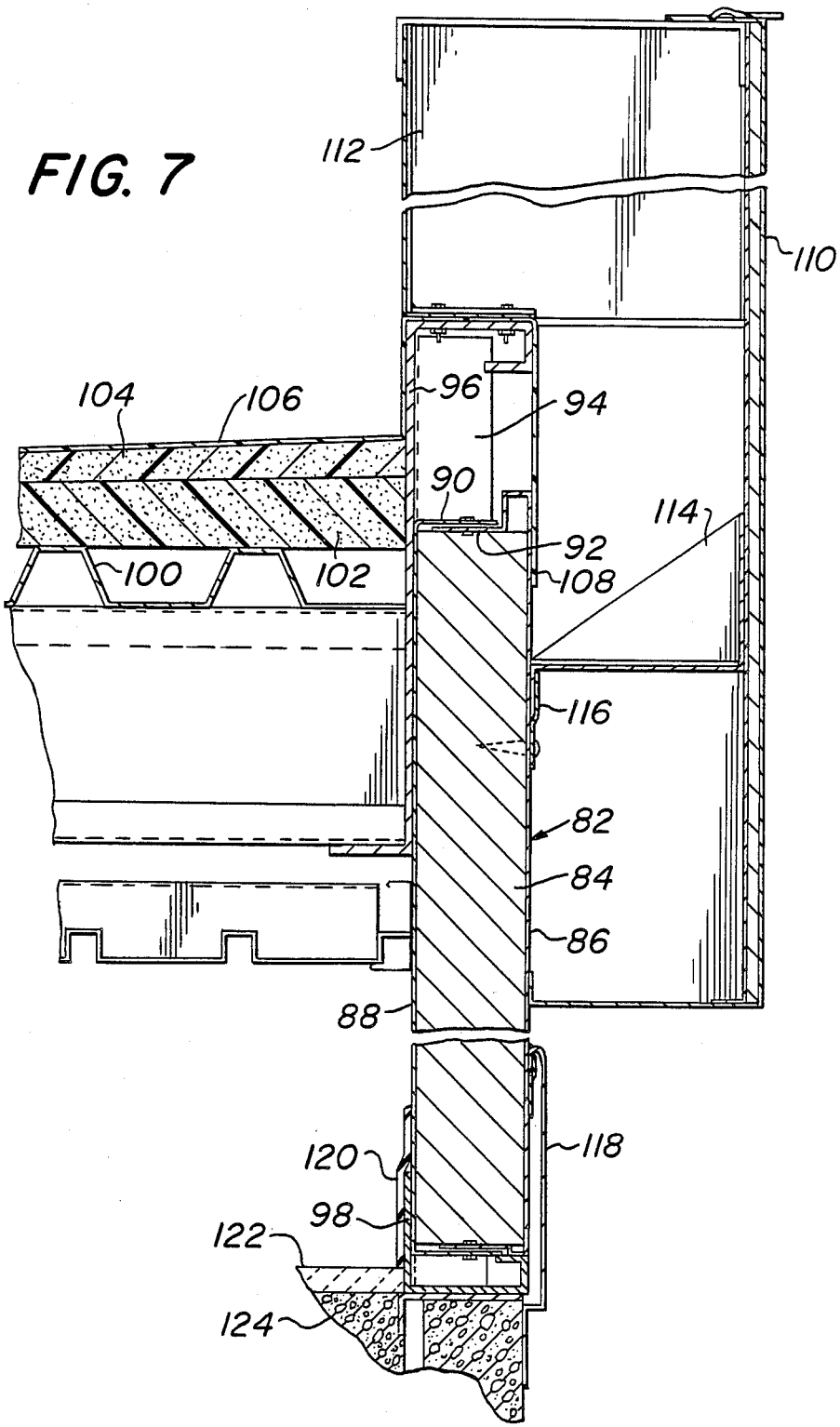
FIG. 7 is a vertical section taken through a typical wall in accordance with the invention on a plane perpendicular to the faces of the wall.

FIG. 7 shows a typical wall panel 82 comprising a core 84 having a sheet metal outer face 86 and a sheet metal inner face 88.

At the top of the wall, a flange 90 of face 88 overlaps a flange 92 of face 86, and both flanges are riveted together. Flanges of the front and rear faces are similarly riveted together at the bottom of the wall.

An upright support column 94 is received in notches in upper and lower horizontal beams 96 and 98, and the column is welded to the beams. Similar columns (not shown) are secured to the beams at spaced intervals, and the wall panels are hung on the columns by engagement of the L-shaped slots in their flanges with the struck-out lances of the columns.

A roof, formed by corrugated metal 100 and synthetic resin layers 102 and 104, is provided with a waterproof membrane 106 which extends over the top of beam 96, and downwardly so that it overlaps the outside face of panel 82 at 108.

A fascia 110 is secured to beam 96 by a series of wide metal channels, one of which is shown at 112, and to face 86 of wall panel 82 by bracket 114 and clip 116. At the bottom of the wall panel, metal outer trim molding is indicated at 118 and inner vinyl molding is indicated at 120. Interior flooring 122 rests on a concrete slab 124, which is an above-ground slab on which the building structure rests.

It will be seen that inner face 88 of the wall panel constitutes part of the interior wall of the building, while outer face 86 constitutes part of the outer wall of the building. Core 84 provides adequate insulation, and the wall structure is of sufficient strength and rigidity, that separate inner and outer walls are unnecessary.

The wall structure can be erected rapidly by first assembling the upper and lower beams, inserting columns vertically in the notches provided in the beams, and then hanging wall panels between the columns until the entire wall is complete. Caulking (as seen in FIG. 1 at 44) is applied following assembly of the wall.

The wall in accordance with the invention is easily and rapidly assembled, requires no exposed fasteners, uses a relatively small number of standard components, and uses a single wall panel layer to form both the interior and exterior building walls. Another significant feature of the invention is the fact that the wall panels, which consist of foam insulation sandwiched between metal sheets, form extremely strong structural elements and require only a minimum support framework. The uprights as well as the flanges of the exterior faces of the panels can be of comparatively light gauge sheet metal because they reinforce each other when they come into engagement, thereby providing an extremely strong and rigid structure resistant to damage by wind loads and other forces.

The invention may be modified in many respects without departing from its scope as defined in the following claims.

We claim:

1. In a building, a wall comprising an upright support column with first and second wall panels attached to the column on opposite sides thereof, said panels having coplanar inner faces and coplanar outer faces characterized in that:

each panel has a core of insulating material between its inner and outer faces;

the coplanar inner faces of the wall panels constitute a part of the facing of an interior wall of the building and the coplanar outer faces of the wall panels constitute part of the facing of an exterior wall of the building;

the column is in the form of a sheet metal channel having a substantially U-shaped horizontal cross-section and comprising two parallel, spaced, opposed, vertically elongated plates extending perpendicular to the planes of said faces of the panels from font to rear, the column having a front opening substantially equal in width to the spacing between said plates and being connected at the rear by a web, said web having an inner side facing the space between said elongated plates and an outer side, each plate having an inner face facing toward the opposite plate, and each plate having a series of vertically spaced struck-out lances extending both inwardly from its inner face toward the opposite plate, and upwardly toward the top of the column;

the outer face of each panel is a metal sheet extending to a vertical line located approximately midway between the planes of the inner faces of the plates of the column and having a flange with a first flange portion extending perpendicular to the panel faces toward the web of the column, a return portion extending parallel to, and spaced rearwardly from the plane of said outer face, and a third flange portion extending from the return portion perpendicular to the planes of said faces, the third flange portion having a vertical edge and a series of vertically spaced L-shaped slots, each slot having a horizontal leg opening to said edge and a vertical leg extending upwardly from the horizontal leg at a location in said third flange portion spaced from said edge;

said third flange portion of one panel is in facing contact with the inner face of one of said plates of the column and said third flange portion of the other panel is in facing contact with the inner face of the opposite plate;

the lances of each plate are received in the vertical legs of L-shaped slots of the third flange portion with which the face of the plate is in facing contact;

the outer side of said web is substantially coplanar with the inner faces of said panels and also constitutes a part of the facing of said interior wall of the building; and said first flange portions of the first and second wall panels are in close proximity to each other and have a seal between them.

2. A wall according to claim 1 in which each of the lances comprises at least one camming surface facing both upwardly and toward the plate from which the lance is struck out, said camming surface being in engagement with the upper boundary of the vertical leg of the L-shaped slot receiving the lance, whereby the weight of the wall panels acting against the camming surface of the lances causes the third flange portions of the wall panels to be urged tightly against the plates of the column.

3. A wall according to claim 2 in which the width of the lance at the location at which the lance meets its plate is substantially equal to the width of the upper boundary of the vertical leg of the slot receiving the lance, whereby the engagement of the lance with said leg prevents the third flange portion having the slot from moving relative to the column in directions perpendicular to the planes of said faces.

4. A wall according to claim 2 in which each of the lances has a tapered portion extending from the location at which the lance meets its plate both inwardly toward the opposite plate and upwardly toward the top of the column, the width of the tapered portion at said location being substantially equal to the width of the upper boundary of the vertical leg of the slot receiving the lance, whereby the engagement of the lance with said leg prevents the flange having the slot from moving relative to the column in directions perpendicular to the planes of said faces.

5. A wall according to claim 1 in which a portion of each lance extending from the inner face of the plate from which it is struck out to an intermediate location on the lance, has a curved cross-section transverse to the direction in which said portion of the lance extends, whereby the lance is reinforced against bending.

6. A building wall according to claim 1 in which the third flange portion on each panel has a flared portion extending along said vertical edge, whereby the vertical edge is spaced from the plate with which the third flange portion is in facing contact.

* * * * *